United States Patent [19]

Strate

[11] Patent Number: 4,813,892

[45] Date of Patent: Mar. 21, 1989

[54] MULTI-POLE PLUG CONNECTOR

[75] Inventor: Klaus Strate, Detmold, Fed. Rep. of Germany

[73] Assignee: C. A. Weidmuller GmbH & Co., Detmold, Fed. Rep. of Germany

[21] Appl. No.: 21,771

[22] Filed: Mar. 4, 1987

[30] Foreign Application Priority Data

Mar. 5, 1986 [EP] European Pat. Off. ..... 86 102 926.2

[51] Int. Cl.[4] ..... H01R 13/645

[52] U.S. Cl. ..... 439/681; 439/680

[58] Field of Search ..... 439/677, 678, 679, 680, 439/681; 639/709, 712, 717

[56] References Cited

U.S. PATENT DOCUMENTS

| | | | |
|---|---|---|---|
| 3,299,392 | 1/1967 | Evans | 439/681 |
| 3,656,086 | 4/1972 | Debaigt | 439/681 |
| 4,376,565 | 3/1983 | Bird et al. | 439/681 |
| 4,693,531 | 9/1987 | Raphal et al. | 439/680 |

*Primary Examiner*—Eugene F. Desmond
*Attorney, Agent, or Firm*—Laubscher, Presta & Laubscher

[57] ABSTRACT

A multi-pole plug connector is formed as a strip which includes a plurality of plug parts or socket parts having different respective numbers of poles; a plurality of corresponding socket parts or plug parts respectively insertable into the strip; coding elements arranged in the plug parts and the socket parts; first cooperating contours provided on the plug parts and the socket parts, and including a plurality of projections and a plurality of recesses arranged in a pattern with a predetermined pattern spacing, except in corner regions of the strip, so that the projections are normally engageable in the recesses when the plug parts are plugged into the socket parts; the corner edges of the plug parts and of the socket parts forming abutment edges of the parts, and including projection-free regions provided in the corner edges which deviate from the patterned contours so as to be purposely mismatched and nonfittingly collidable with the latter, the contours being provided with additional recesses in correspondence with the pattern spacing, but formed so that in the additional recesses either one of the further projections or a blocking element preventing the insertion of the one further projection can be inserted, and wherein the outlines of the blocking element and the one further projection are partially overlapping.

6 Claims, 3 Drawing Sheets

MULTI-POLE PLUG CONNECTOR

The present invention relates to a multi-pole plug connector. More particularly, it relates to a multi-pole plug connector which has a strip with a plurality of plug or socket parts of different respective pole numbers, (the poles are electrically conductive contacts) and corresponding socket and plug parts for insertion into the strip, and wherein the plug parts and the socket parts are provided with receptacles for receiving coding elements.

Plug connectors of the above-described general type are known in the art. The conventional coding of plug connectors is performed by providing the receptacles in the plug parts, on the one hand, and in the socket parts, on the other hand, and inserting into these receptacles the coding elements which correspond to the desired coding. In different embodiments, the positions of the receptacles and the type of the coding elements are different. Plug connectors of this type are disclosed, for example, in the German documents DE-B-No. 28 07 017, DE-A-No. 34 17 855, DE-C-No. 30 14 804. With this type of coding it is possible to code plug and socket parts with equal corresponding pole numbers. However, the coding becomes problematic when long strips with high total pole numbers are used, and where the coding must prevent interengagement of plug parts and socket parts with non-equal pole numbers. The problem is especially significant, when there are many plug and socket parts of low pole numbers, for example two- or three-pole parts, and when it must be additionally ensured that if necessary, a part with a greater number of poles, for example a six-pole socket part, can be inserted in the strip into such a plug part which has six poles and is assembled, on manufacturing grounds, from two three pole-plug parts or for example, from three two-pole plug parts.

This limited number of coding possibilities inherent in such a system is not sufficient in the above-mentioned applications with the use of the conventional coding systems. A certain alleviation can be obtained in these cases when the poles themselves are introduced into the coding, which naturally leads to loss of poles.

SUMMARY OF THE INVENTION

Accordingly, it is an object of the present invention to provide a multi-pole plug connector which avoids the disadvantages of the prior art.

More particularly, it is an object of the present invention to provide a multi-pole connector which makes possible, with structurally simple means and without any loss of poles, to prevent false interconnection of the plug parts and the socket parts with each other not only of equal pole numbers, but also prevents false interconnection of plug parts and socket parts of non-equal pole numbers.

It is also an object of the present invention to provide a multi-pole plug connector which, in addition, to the above-described advantages, also provides for a possibility to connect a strip portion assembled from several plug or socket parts of a smaller pole number not only with the associated parts of the respective equal pole number in an equal row sequence, but also when necessary to connect it with a socket part or a plug part of a greater pole number which then corresponds to the total pole number, with interengagement of the respective parts.

In keeping with these objects and others which will become apparent hereinafter, one feature of the present invention resides, briefly stated, in a multi-pole plug connector formed as a strip which includes a plurality of plug parts or socket parts having different respective numbers of poles; a plurality of corresponding socket parts or plug parts respectively insertable into the strip; coding elements arranged in the plug parts and the socket parts; first cooperating contours provided on the plug parts and the socket parts, and including a plurality of projections and a plurality of recesses arranged in a pattern with a predetermined pattern spacing, except in corner regions of the strip, so that the projections are normally engageable in the recesses when the plug parts are plugged into the socket parts, second cooperating contours provided on the plug parts and the socket parts and including a plurality of further projections and a plurality of further recesses arranged in the pattern with the pattern spacing, except again in the corner edges of the strip; the corner edges of the plug parts and of the socket parts forming abutment edges of the parts, and including projection-free regions provided in the corner edges which deviate from the patterned contours so as to be purposely mismatched with the latter, the contours being provided with additional recesses in correspondence with the pattern spacing, but formed so that in the additional recesses either one of the further projections or a blocking element preventing the insertion of the one further projection can be inserted, and wherein the outlines of the blocking element and the one further projection are partially overlapping.

Due to the introduction of the contour of the plug parts and the socket parts into the coding, it is possible without any problems by means of the patterned contours, but which have differently designed contour corner edges, to prevent a false interengagement of the plug parts and the socket parts of respective non-equal pole numbers. The reason is that in the above case, at least one corner edge of the part with a smaller pole number would collide with the patterned contour of another part having a greater pole number so that their assembly will be impossible. The coding is achieved without any loss of any poles, it is structurally simple and can be produced, for example, with the use of extrusion in a simple manner by a simple tool.

Because of the above-described construction it is possible to connect a strip which has a plurality of relatively small number of poles, for example, a plug strip, with a socket strip which is also assembled from parts with a correspondingly low number of poles, but in any case arranged in the same row sequence. Within this row arrangement, it is not possible to insert such strip portions into one another, in which the individual elements are provided with different respective pole numbers, and are of different respective designs, despite the total number of poles being the same.

Due to the second contours and the respective design of the corner edges in correspondence with the design of the abutment edges of the parts in the bearing region of the second contours, it is also possible to insert a continuous and unitary plug or socket strip portion with the same pole number into a strip portion which is composed of several individual parts and has a predetermined total number of poles, with interengagement of the respective parts. The reason is that with such contours in the corner edge regions and thereby the abutment edges of the parts, corresponding receptacles for the neighboring parts are formed, which make possible in principle accommodation of a corresponding projection provided in the pattern on the plug or socket part with a greater pole number. If this possibility is not used and is instead prevented within the scope of the total coding, a blocking element is inserted in this special receptacle in the corner edge or the abutment edge region so as to prevent such insertion.

It has to be emphasized that in this manner the available conventional coding by the coding elements insertable into the receptacles of the plug parts and socket parts is fully maintained, so as to exclusively prevent any undesirable engagement of the plug parts and the socket parts having equal respective numbers of poles.

The present invention is set forth in particular in the appended claims. The invention itself, however, both as to its construction and method of operation, will be best understood from the following description of preferred embodiments, which is accompanied by the following drawings.

DESCRIPTION OF PREFERRED EMBODIMENTS

Figure 1:
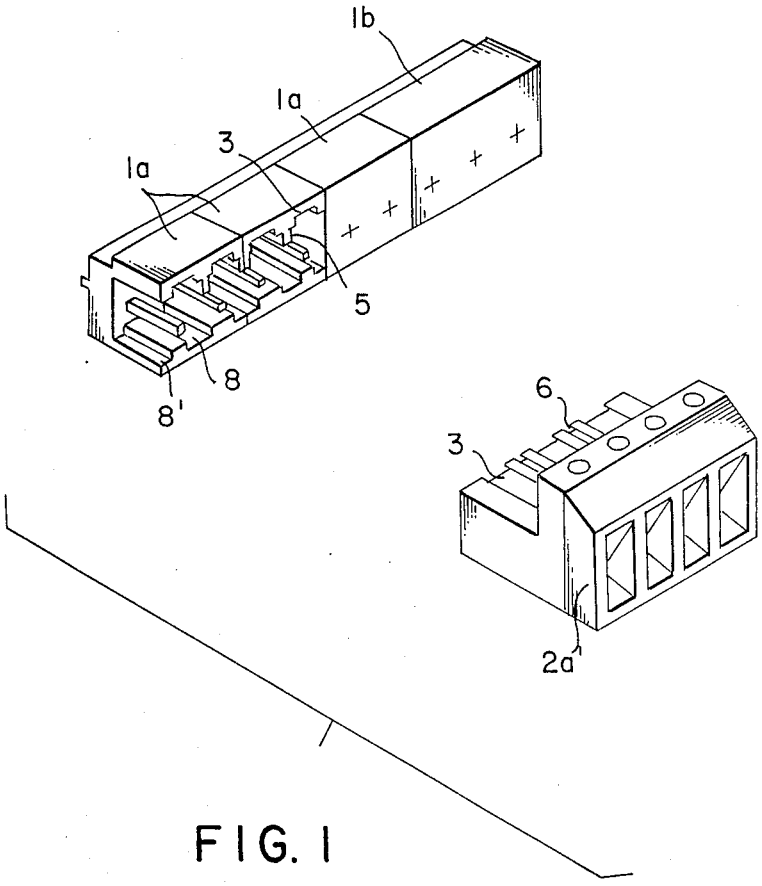
FIG. 1 is a perspective, partially schematic view of a plug connector in accordance with the present invention, with a plug strip having several plug parts of different respective numbers of poles, and with an associated socket part.

FIG. 1 shows a plug strip with a high total number of poles. For example, it contains in one of its portions a row of three two-pole plug parts 1*a* and one three-pole part 1*b*. Further plug parts with different respective numbers of poles can be provided in the strip. Such plug strips can be formed, for example, of conductive plates, so that after formation of the plug strip from individual plug parts, the connecting joints between the individual plug parts 1*a*, 1*b* etc. are hardly visible and therefore the danger of any false interengagement of corresponding socket parts is significant.

For the sake of simplicity, in FIG. 1 only one four-pole socket part 2*a*′ of the associated socket parts is shown. There exists the requirement, on the one hand, of always connecting the plug parts and the socket parts of the same number of poles, while avoiding false interengagement. On the other hand, there is also the requirement to provide for the connection of a number of poles, for example a strip portion formed by four adjacently arranged two-pole plug parts 1*a* (FIG. 3), in plug connection with a unitary eight-pole socket part 2*a*″ (FIG. 3), while also providing for the possibility of blocking this connection as undesirable, when necessary. The basic requirement of the coding remains to prevent any undesirable interengagement of several plug parts provided in one strip, even in the case of corresponding socket parts having a number of poles identical to those of the plug parts.

As can be seen from the drawings, for avoiding false plugging of socket parts and plug parts with different respective number of poles, and also in assembled strip portions, the upper cooperating contours of the plug and socket parts include projections and recesses with a predetermined pattern. However, the corner edges of the contours are formed differently so as to collide with the above-mentioned patterned contours.

In the illustrated embodiment, the plug parts 1*a*, 1*b* and the socket parts 2*a*′, 2*a*″, 2*b*, 2*b*′ have cooperating upper contours which include a plurality of recesses 3. The recesses 3 of each part are open toward a corresponding counter part, are disposed opposite one another after being plugged into one another, and follow a predetermined pattern with a pattern spacing (x). As can be seen from FIG. 4, coding elements 4 are insertable into the recesses 3. For preventing false interengagement of plug parts and socket parts with different respective numbers of poles, the plug parts 1*a*, 1*b* in the illustrated embodiment are provided in their central region between the recesses 3 for the coding elements, with projecting ribs 5, which in the plug parts with a high number of poles follow the same pattern spacing (x). On the other hand, the socket parts 2*a*′, 2*a*″, 2*b*, 2*b*′ are provided at respective locations with grooves 6 for receiving the ribs 5.

However, the corner edges and thereby the abutment edges of the parts in the row are formed differently from the patterned contour of the ribs 5 and grooves 6, so as to collide with this patterned contour. As shown in the drawings, the upper corner edges of the socket parts 2*a*′, 2*a*″, 2*b*, 2*b*′ are solid, despite the fact that if one were to follow the pattern spacing (x), partial recesses corresponding to the groove 6 would be provided in this region.

The lower side of the plug parts 1*a*, 1*b* and the socket parts 2*a*′, 2*a*″, 2*b*, 2*b*′, which cooperate with one another in the plug connection, are also provided with contours formed by projections and recesses, which are symmetrically offset relative to the contours of the upper sides. In the shown embodiment the socket parts 2*a*′,2*a*″,2*b*, 2*b*′ have relatively wide ribs 7, while the plug parts 1*a*, 1*b* have in their central region grooves 8 with a completely complementary contour. The ribs 7 and the grooves 8 follow the pattern spacing (x) but having sizes which are different from the sizes of the ribs 5 and grooves 6. Here also the cooperating lower sides have a special corner edge construction, or in other words also a corresponding formation of the abutment edges of the parts in their row arrangement. The corner edge regions of the socket parts 2*a*′,2*a*″, 2*b*, 2*b*′ are left without a corresponding rib 7 or a corresponding part of the ribs 7, which follow the pattern spacing. The corner edge regions of the plug parts 1*a*, 1*b* are provided with undercut groove portions at the pattern spacing (x) of the grooves 8, so that the groove portions in two neighboring parts together form an additional undercut composite groove 8′. The size of the groove 8′ is selected so that, if needed, at its narrowest point there is always provided a sufficient passage for inserting the wide rib 7.

Special blocking elements 9 are also provided in the inventive plug connector for securing adjacent plug parts. The blocking elements 9 have a cross-section which corresponds to the groove 8', so that they can be inserted in these grooves without the cross-section of the blocking element 9 completely overlapping the cross-section of the groove 8' and, in particular without projecting somewhat upwardly beyond the groove 8. With the insertion of such a blocking element 9 into the groove 8' formed at the abutment edges of two neighboring parts, a possible insertion of a rib 7 in this groove 8' can be prevented when necessary.

A plurality of structural possibilities for preventing any false interengagement of the plug parts and socket parts are shown in the drawings. The collision regions which prevent the false interengagement of the cooperating contours of the plug parts and socket parts are identified by the reference C.

Figure 2:
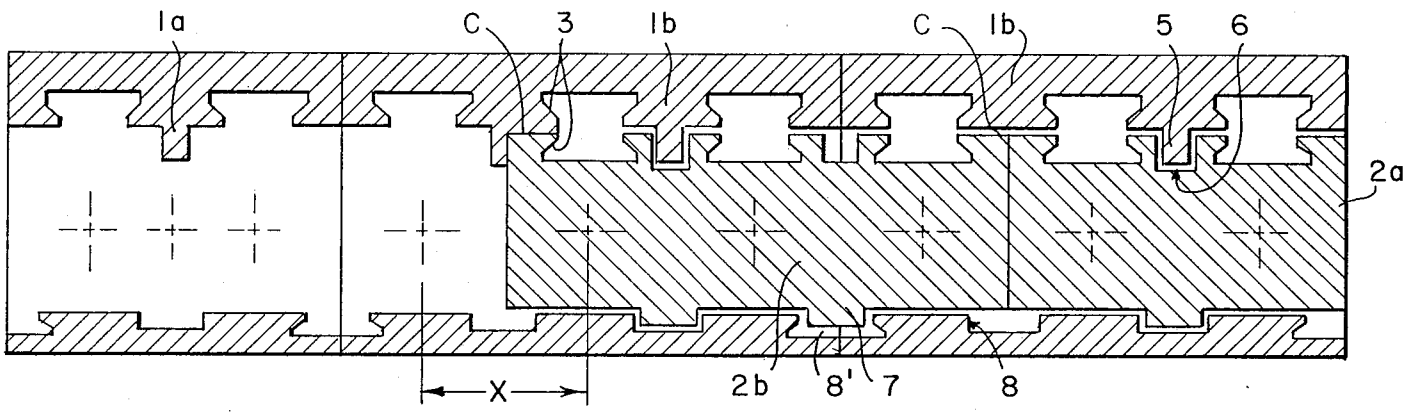
FIG. 2 is a view showing the inventive plug connector with a strip portion formed by two three-pole and one two-pole plug parts, and illustrating prevention of any false insertion for a two-pole and a three-pole socket part.

FIG. 2 illustrates in an exemplary manner that in the strip portion formed by the interconnection of one two-pole plug part 1*a* and two three-pole plug parts 3*b*, it is not possible to insert from a so-called false side one two-pole socket part 2*a* and one three-pole socket part 3*b*, nor to assemble from this false side a socket portion formed from the two-pole socket part 2*a* and from the three-pole socket part 2*b*. This is so because as a result of the corner edge construction on the cooperating upper sides of the parts which form the plug connection, the nonfitting parts of corner regions of the socket parts 2*a*, 2*b* which, based on the number of poles, would collide with one of the ribs 5 situated in the central region of the plug parts 1*a*, 1*b*.

The illustration also shows that in the illustrated plug strip connection segment a socket strip connection segment could be plugged in without any difficulty, and where such a socket strip connection segment would be constructed from a two-pole socket part in conjunction with two three-pole socket parts, starting from the left side of FIG. 2. The Figure also shows that the individual socket parts of a corresponding number of poles could easily be inserted without any difficulty, provided such a plug connected is not prevented in the usual manner by plugging corresponding coding elements 4 into corresponding plug receptacles 3 of a corresponding plug portion and socket portion.

From the aforesaid it follows that, due to the special contouring plug parts and socket parts having different respective poles cannot be assembled with one another, and wherein also a different sequence having different numbers of poles in a row of strip segments cannot be plugged into one another due to the afore-described collision.

Figure 3:
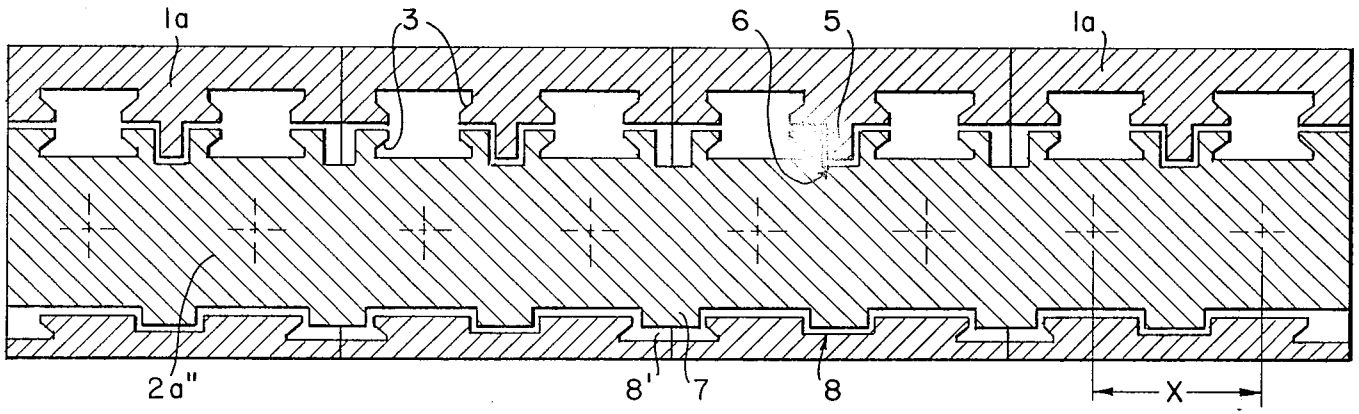
FIG. 3 is a view showing the inventive plug connector with a strip portion composed of four two-pole plug parts, and an inserted one-piece eight-pole socket part.
Figure 4:
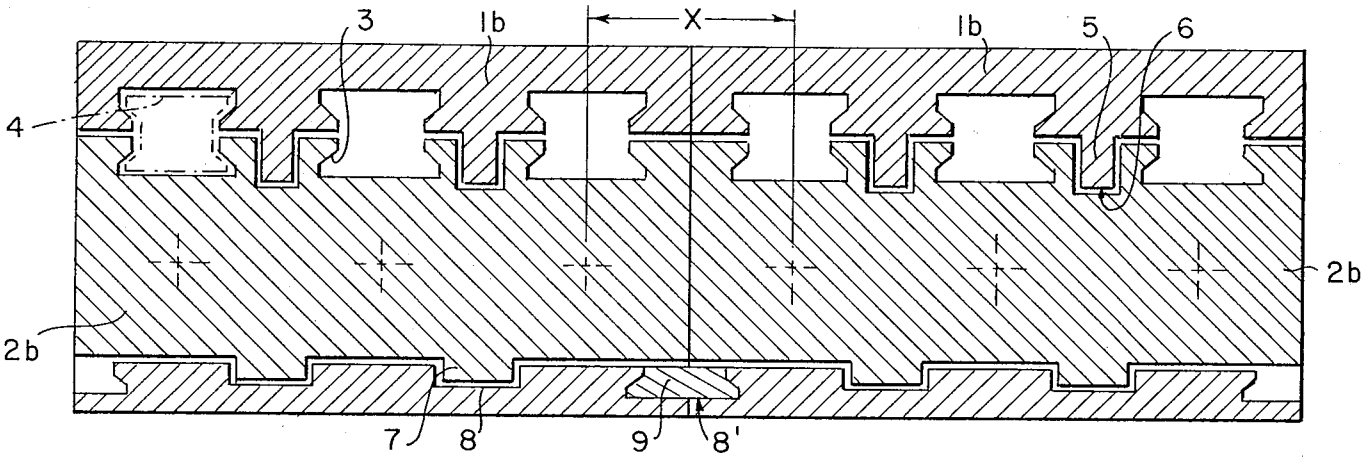
FIG. 4 is a view showing the inventive plug connector with a strip portion formed by two three-pole plug parts in a desired plug connection with two three-pole socket parts, and with the use of a blocking element.

The desired and unobjectionable concept of assembling one part having a higher number of poles with a strip portion composed of parts of a lower number of poles, but resulting nevertheless in the same total number of poles, is illustrated in FIGS. 3 and 4.

FIG. 3 shows a plug strip portion which is formed of four adjacently arranged two-pole plug parts 1*a*, and a unitary eight-pole socket part 2*a''*, which is inserted thereinto in a collision-free manner. In the same manner, the four-pole socket part 2*a'* of FIG. 1 can be inserted in both successively arranged two-pole plug parts 1*a*. In the lower abutment corner regions of the plug parts 1*a*, the grooves 8' form corresponding recesses for the ribs 7, which in turn are arranged in correspondence with the pattern spacing (x) on the socket part. Finally, it should be noted that in the embodiment of FIG. 3, it is naturally possible to insert into the plug strip portion shown there, also a socket strip portion composed of four two-pole socket parts arranged in a row.

FIG. 4 shows that it is possible to insert into a plug strip portion formed, for example, from two adjacent three-pole plug parts 1*b*, a corresponding socket strip portion formed from two three-pole socket parts 2*b*. This is accomplished even when the blocking element 9 is inserted between both plug parts 1*b* in their abutment edge region in the groove 8', so as to avoid the plugged connection shown in relation to FIG. 5, when a blocking element 9 is to be inserted into the so formed groove 8', as will be further illustrated hereinbelow.

The plug connection is possible even in this case, since respective corner edge region and thereby the abutment region of both socket parts are left without a corresponding portion of the rib 7.

For preventing an undesirable interengagement of two otherwise fitting strip portions in the case of FIG. 4, insertion of the conventional coding element in the corresponding recesses 3 of one plug part and one socket part is provided for, as shown in broken lines.

Figure 5:
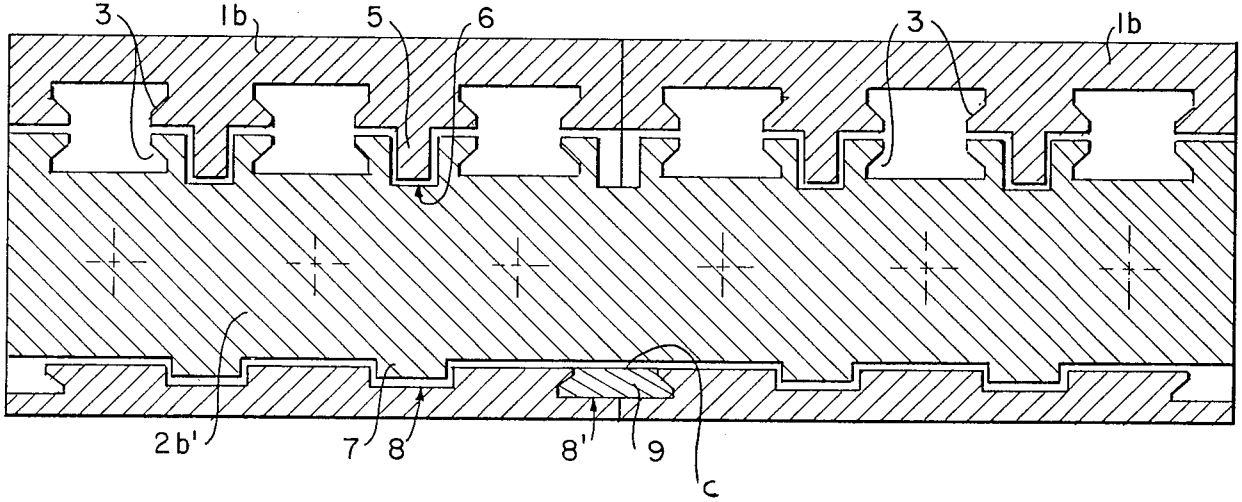
FIG. 5 is a view showing the inventive plug connector with a strip formed by two three-pole plug parts in accordance with FIG. 4, and illustrating prevention of a plug connection with a one-piece six-pole socket part by means of the blocking element.

FIG. 5 further shows a strip portion which is formed from a row of adjacent two three-pole plug parts 1*b*, but in contrast to FIG. 4, a unitary six-pole socket part 2*b'* is provided. In comparison with FIG. 3, which shows a partially overlapping engagement, FIG. 5 shows how, by the insertion of a blocking element 9 into the groove 8' on the abutment edge of both plug parts 1*b*, and when needed, engagement of the six-pole socket part 2*b'* can be prevented. The reason is due to the fact that in the event of a blocking element 9 being inserted, the corresponding rib 7 in the central region can no longer enter the groove 8' in the lower contour of the socket part.

The above-presented embodiments show a plug strip composed of plug parts which are arranged in a row, and socket parts or socket strip portions insertable therein. It is also possible to provide a reverse arrangement in which the socket parts with different respective numbers of poles are united into one long socket strip and, for example, fixed on a conductive plate, while plug parts or plug strip portions are provided for being plugged into the socket strip.

It is also possible to provide contours of different geometrical shape on the cooperating upper sides and lower sides of the plug parts and socket parts, which, for achieving the objects of the present invention, can follow, however, all simple geometrical forms. In contrast to the illustrated construction, the inventive principle can be implemented also when alternately grooves are provided at the locations where present ribs are shown in the drawings, while the corresponding counter part is provided with the ribs.

The present invention is not limited to the details shown, since various modifications and structural changes are possible without departing in any way from the spirit of the invention.

What is desired to be protected by Letters Patent is set forth in particular in the appended claims:

1. A multi-pole plug connector, comprising in combination a strip including a plurality of first paths having different respective numbers of poles;

a plurality of corresponding second parts engageable with said first parts of said strip, one of said first part and second part being a plug part, while the other of said first part and second part is a socket part;

coding means arranged in said plug parts and said socket parts;

first cooperating contours provided on the upper surfaces of said plug parts and said socket parts, respectively, and including a plurality of projections and a plurality of recesses arranged in a pattern with a predetermined pattern spacing, except in corner edges of said strip, so that said projections are normally engageable in said recesses when said plug parts are plugged into said socket parts, second cooperating contours provided on the lower surfaces of said plug parts and said socket parts, respectfully, and including a plurality of further projections and a plurality of further recesses arranged in said pattern with said pattern spacing, except in said corner edges of said strip;

said corner edges of said plug parts and of said socket parts forming abutment edges of said parts with which said parts abut against one another, and said corner edges of said second contours being projection-free to deviate from said patterned contours so as to be purposely mismatched and non-fittingly collidable with the latter, said second contours being provided with additional recesses in correspondence with said pattern spacing, but formed so that in said additional recesses either one of said further projections or a blocking element preventing said insertion of said one further projection can be inserted, and wherein the outlines of said blocking element and said one further projection are partially overlapping, thereby constituting a safeguard against any false interengagement of said socket parts with said plug parts.

2. A multi-pole plug connector as defined in claim 1, wherein said coding means includes a plurality of insertion recesses provided in said plug parts and said socket parts, respectively, and coding elements insertable into said insertion recesses.

3. A multi-pole plug connector as defined in claim 2, wherein said insertion recesses of said coding means are arranged in accordance with said pattern spacing, said insertion recesses in said plug parts and in said socket parts facing toward one another and being open toward one another.

4. A multi-pole plug connector as defined in claim 1, wherein each of said plug parts and said socket parts have upper surfaces provided with said cooperating first contours, which include said first-mentioned projections formed as ribs in a central region of said socket parts, and said first-mentioned recesses formed as grooves in a central region of said plug parts, said corner edges of said socket parts being solid without any ribs and therefore different from the pattern of said pattern spacing, while said corner edges of said plug parts are formed without any grooves and are therefore also different from said pattern of said pattern spacing.

5. A multi-pole plug connector as defined in claim 1, wherein each of said additional recesses has a dove-tail shape and is composed of two semi-recesses formed in corresponding two of said parts abutting against one another at said abutment edges, each of said dove-tail shaped additional recesses having a narrowest part formed so that said further projection can pass therethrough; and further comprising a blocking element which has a cross-section substantially corresponding to said dove-tail shaped additional recesses, but not completely overlapping the latter.

6. A multi-pole plug connector as defined in claim 1, wherein said plug parts and said socket parts have upper surfaces and lower surfaces, said upper surfaces being provided with said first cooperating contours including said projections and recesses formed as ribs and grooves in correspondence with said pattern spacing, said lower surfaces being provided with said second cooperating contours including said further projections and recesses formed as further ribs and grooves in a central region of said lower surfaces, said further ribs and grooves being also arranged in correspondence with said pattern spacing, but having sizes which are different from those of said ribs and grooves of said first contours.

* * * * *